United States Patent [19]

Lokar et al.

[11] Patent Number: 4,972,067

[45] Date of Patent: Nov. 20, 1990

[54] PTC HEATER ASSEMBLY AND A METHOD OF MANUFACTURING THE HEATER ASSEMBLY

[75] Inventors: Raymond S. Lokar, Lakeline; Richard A. Lokar, Orwell, both of Ohio

[73] Assignee: Process Technology Inc., Mentor, Ohio

[21] Appl. No.: 369,246

[22] Filed: Jun. 21, 1989

[51] Int. Cl.[5] ..... H05B 1/00; H05B 3/00

[52] U.S. Cl. ..... 219/505; 338/238

[58] Field of Search ..... 219/504, 505, 335, 544; 338/238, 239, 240, 242, 214, 235, 22 R

[56] References Cited

U.S. PATENT DOCUMENTS

| | | | |
|---|---|---|---|
| 2,767,288 | 10/1956 | Lennox | 338/238 |
| 2,803,566 | 8/1957 | Smith-Johannsen . | |
| 3,397,302 | 8/1956 | Hosford . | |
| 3,793,716 | 2/1974 | Smith-Johannsen . | |
| 3,885,129 | 5/1975 | Fabricuis . | |
| 3,996,447 | 12/1976 | Boulfard . | |
| 4,072,848 | 2/1978 | Johnson . | |
| 4,091,267 | 5/1978 | Grant . | |
| 4,104,509 | 8/1978 | Van Bokestal . | |
| 4,147,927 | 4/1979 | Pirotte | 219/505 |
| 4,210,800 | 7/1980 | Van Bokestal . | |
| 4,236,065 | 11/1980 | Yashin . | |
| 4,242,573 | 12/1980 | Batliwalia . | |
| 4,245,146 | 1/1981 | Shioi . | |
| 4,246,468 | 1/1981 | Horsma . | |
| 4,250,400 | 2/1981 | Lee . | |
| 4,309,596 | 1/1982 | Crowley . | |
| 4,315,237 | 2/1982 | Middleman . | |
| 4,327,282 | 4/1982 | Nauerth . | |
| 4,331,860 | 5/1982 | Roller . | |
| 4,331,861 | 5/1982 | Meixner . | |
| 4,334,148 | 6/1982 | Kampo . | |
| 4,368,380 | 1/1983 | Igashira . | |
| 4,371,777 | 2/1983 | Roller . | |
| 4,395,623 | 7/1983 | Shimada . | |
| 4,414,052 | 11/1983 | Habata . | |
| 4,426,573 | 1/1984 | Fudickar . | |
| 4,482,801 | 11/1984 | Habata . | |
| 4,493,972 | 1/1985 | Steinel . | |
| 4,540,972 | 9/1985 | Davis | 338/238 |
| 4,541,898 | 9/1985 | Unnamed . | |
| 4,544,828 | 11/1985 | Shigenobu . | |
| 4,689,878 | 9/1987 | Beauregard . | |
| 4,701,597 | 11/1987 | Braun . | |
| 4,721,848 | 1/1988 | Malone . | |
| 4,730,103 | 3/1988 | Hawkins . | |
| 4,733,057 | 3/1988 | Stanzel . | |
| 4,759,189 | 8/1988 | Stropkay . | |
| 4,831,241 | 5/1989 | Shikama et al. | 219/504 |

*Primary Examiner*—Roy N. Envall, Jr.
*Assistant Examiner*—Tu Hoang

[57] ABSTRACT

A self-regulating PTC heater assembly and a method of manufacturing the heater assembly is disclosed. PTC heater assembly includes a plurality of positive temperature coefficient devices, a plurality of spacers located between the positive temperature coefficient devices, a pair of metallic electrodes and a heat shrink tubing surrounding the pair of electrodes, PTC elements and spacers to hold the PTC elements and electrodes in place during assembly. A metallic sheath is compressed about the heat shrink tubing to establish uniform electrical contact between the PTC elements and the electrodes, to increase the thermal efficiency of the heater and to protect the heater assembly from physical damage.

22 Claims, 1 Drawing Sheet

PTC HEATER ASSEMBLY AND A METHOD OF MANUFACTURING THE HEATER ASSEMBLY

TECHNICAL FIELD

The present invention relates generally to a heater assembly and more particularly to a self-regulating PTC heater assembly which is adapted for use in hostile environments.

BACKGROUND OF THE INVENTION

PTC heater assemblies are well known in the art. A PTC or positive temperature coefficient device is a semiconductor which has an electrical resistance which is temperature sensitive. The electrical resistance of the PTC device varies proportionately with temperature. PTC devices are available as ceramics or polymers and are well known for use in temperature sensors, current limiters and heaters. Their usefulness as a heater is particularly attractive due to the fact that a self regulating heater can be constructed. When a current is passed through a PTC device, it produces heat by virtue of the internal resistance of the PTC device and the resultant current is similar to that of other resistance heaters except that at a certain predetermined temperature (curie point or autostabilizing temperature), the resistance begins to increase virtually exponentially causing the power to decrease thereby autostabilizing the PTC device at a particular predetermined temperature. The temperature at which the PTC device autostabilizes will vary depending upon the specific PTC device. In the present invention, the autostabilizing temperature of the PTC device is useful because it can be established at a temperature which is below the ignition temperature of the heaters environment.

PTC heaters have not been particularly successful in the prior art when used in hostile environments such as in the chemical processing industry. In such hostile environments, strong oxidizers, free halogen ions and strong reducing acids contribute to the degregation of PTC assemblies.

In conventional resistance heaters utilized in hostile environments, the use of plastics and in particular fluoropolymers has proven successful but such plastics were unpractical with respect to their use in protecting PTC devices because a plastic with sufficient thickness to resist the hostile environment generally produces sufficient thermal resistance to increase the temperature of the PTC device above its autostabilizing temperature rendering it ineffective as a heating device.

DISCLOSURE OF THE INVENTION

The present invention provides a new and improved PTC heater construction and a method for manufacturing the heater construction which provides for a self-regulating heater which is particularly adapted for use in hostile environments.

A provision of the present invention is to provide a new and improved self-regulating heater assembly which includes a plurality of positive temperature coefficient devices, a pair of low electrical resistance electrodes, preferably metallic, for energizing the positive temperature coefficient devices, a heat shrink tubing surrounding the pair of electrodes and the PTC elements to hold or fixture the assembly and a swaged metallic outer covering to protect the PTC elements from physical damage, to establish uniform electrical contact between the PTC elements and the electrodes and to increase the thermal efficiency of the heater.

Another provision of the present invention is to provide a new and improved self-regulating heater assembly which includes a plurality of positive temperature coefficient elements each of which includes a pair of substantially planar parallel surfaces, a plurality of resilient electrically insulative and thermally conductive spacers located between the PTC elements to permit forming of the finished assembly, a pair of metal electrodes for energizing the plurality of PTC elements, each of which has a planar surface, each of the planar surfaces of the metal electrodes being contiguous to and in contact with one of the planar surfaces of each of the PTC elements, a heat shrink tubing surrounding the pair of metal electrodes and being shrunk in situ to fix or hold the assembly of the aforesaid PTC elements, spacers and electrodes and a metallic housing swaged over the aforesaid assembly to establish substantially uniform electrical contact between the PTC elements and the electrodes and to increase the thermal efficiency of the assembly.

DESCRIPTION OF A PREFERRED EMBODIMENT

Figure 1:
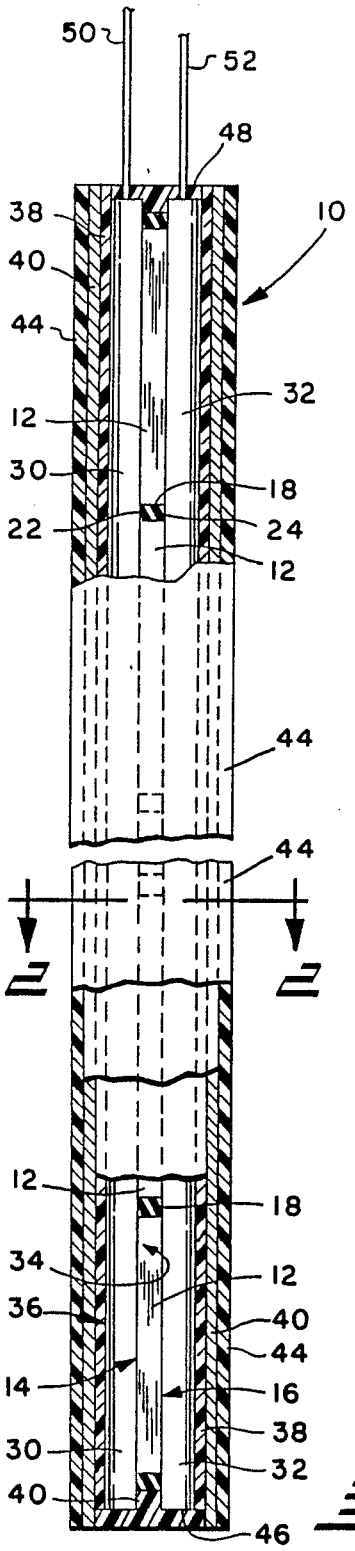
FIG. 1 is a cross-sectional view showing the heater assembly of the present invention.
Figure 2:
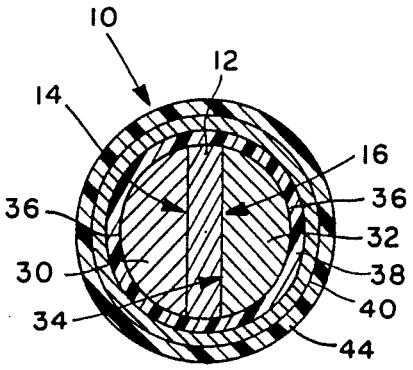
FIG. 2 is a cross-sectional view more fully showing the heater assembly of the present invention taken approximately along the line 2—2 of FIG. 1.

FIGS. 1–2 disclose the new self-regulating heater 10 of the present invention. The heater 10 includes a plurality of positive temperature coefficient elements 12 each of which includes parallel planar surfaces 14 and 16 and a plurality of spacers 18 of an electrically insulative and thermally conductive material which are disposed between the plurality of PTC elements 12 to space adjacent PTC elements 12. The spacers 18 each includes a pair of planar parallel surfaces 22 and 24. The surfaces 14 and 16 of each of the PTC elements 12 are disposed coplanar to the surfaces 22 and 24 of the plurality of spacers 18. The spacers 18 of electrically insulative and thermally conductive material 18 are preferably constructed of iron oxide compounded in silicon rubber which would space each of the PTC elements 12 and which would provide good heat transfer to the surrounding environment from the PTC elements when they are energized. The iron oxide provides for a good thermal conductivity from the PTC elements 12. Other metallic oxides such as aluminum oxide, magnesium oxide or zirconium oxide with or without silicone rubber could also be used.

A pair of elongate low electrical resistance current conducting electrodes 30, 32 are provided for energizing each of the PTC elements 12. Electrodes 30, 32 each include a planar surface 34 and are preferably made from a suitable metallic material such as an electrical grade copper or aluminum alloy. The planar surfaces 34 are each disposed contiguous to the planar surfaces 14, 16 of each of the PTC elements 12 and to the planar surface 22, 24 of the spacers 18. Electrodes 30, 32 each include an arcuate surface 36. Arcuate surfaces 36 of each of the electrodes 30, 32 cooperate to define a substantially circular cross-sectional configuration for the heater assembly 10 as is more fully disclosed in FIG. 2.

A heat shrink tube 38 is disposed about electrodes 30 and 32, spacers 18 of electrically insulative and thermally conductive material, and PTC elements 12. Heat shrink tubing 38 is made from a high temperature resistant polymer such as a fluorocarbon polymer or a ethylenated fluorocarbon polymer or a chlorinated fluorocarbon polymer or an ethylenated/chlorinated fluorocarbon polymer or a polyvinyl fluorocarbon polymer and preferably from a perfluoroalkoxy polymer sold under the trademark PFA by the DuPont company which is shrunk in situ. To assemble heater 10, the spacers 18 of electrically insulative and thermally conductive material are located between the plurality of PTC elements 12 and electrodes 30, 32 are then disposed on either side of PTC elements 12 and spacers 18. Heat shrink tubing 38 is then disposed about the assembly of the electrodes 30, 32, PTC elements 12 and spacers 18. The heat shrink tubing 38 is then heated in situ to fixture and hold the electrodes 30, 32 in contact with the surfaces 14 and 16 of the PTC elements to thereby maintain assembled position between the planar surface 34 of each of the electrodes 30, 32 and surfaces 14 and 16 of the PTC elements. The heat shrink tubing 38 positively locates each PTC element 12 and the spacers 18 of material to thereby simplify the construction of the heater assembly 10.

A metallic sheath 40 is disposed about the outside of heat shrink tubing 38 to further protect the PTC elements 12 from hostile environments and physical damage. Moreover, metallic sheath 40 also serves as an electrical conductor and ground path circuit for the heater assembly if short circuiting occurs. To this end, a ground conductor, not illustrated, can be connected to metallic sheath 40 to serve as a ground path circuit to protect operating personnel in the event of an electrical fault condition. The metallic sheath 40 also provides for good heat transfer from the PTC elements 12 to the environment when the PTC elements 12 are energized.

The metallic sheath 40 fits snugly around heat shrink tubing 38. This may be accomplished by roll reducing or swaging the metallic sheath 40 about the heat shrink tube 38. The arcuate surfaces 36 of the electrodes act to transfer the radial inward forces from the swaged outer tube 40 to the PTC elements 12. Such a construction overcomes many of the disadvantages associated with the prior art wherein spring means were provided to bias the electrodes into contact with the PTC elements. Not only does swaged metallic tubing 40 maintain substantially uniform contact pressure between PTC elements 12 and electrodes 30 32, it also acts to enhance the thermal characteristics of the heater assembly. The swaging or roll reducing operations reduces any air voids in the heater assembly which would decrease the thermal efficiency of the heater assembly. The heat shrink tubing 38 positively locates each PTC element 12 and the spacers 18 of material to thereby simplify the construction of the heater assembly 10. If desired, the metallic tube can be filled with a metallic oxide powder prior to swaging to fill any voids, protect the PTC devices 12, and provide for a thermally conductive material to radiate heat away from the PTC devices 12 when they are energized.

A protective sleeve 44 surrounds metallic sheath 40 to further protect heater assembly 10 from hostile environments. The sleeve 44 is preferably a heavy walled sleeve that completely surrounds assembly 10 to protect it from hostile environments. Sleeve 44 is made from a heat resistant and preferably from a chemical and heat resistant material such as previously described for making shrink tubing 38. A plug 46 made from the same material is provided at the bottom of heater assembly 10 to seal the bottom portion thereof. Moreover, a heat resistant epoxy 48 can be poured into the top portion of the heater assembly 10 as is disclosed at 48 to seal the top portion of the heater assembly.

Figure 3:
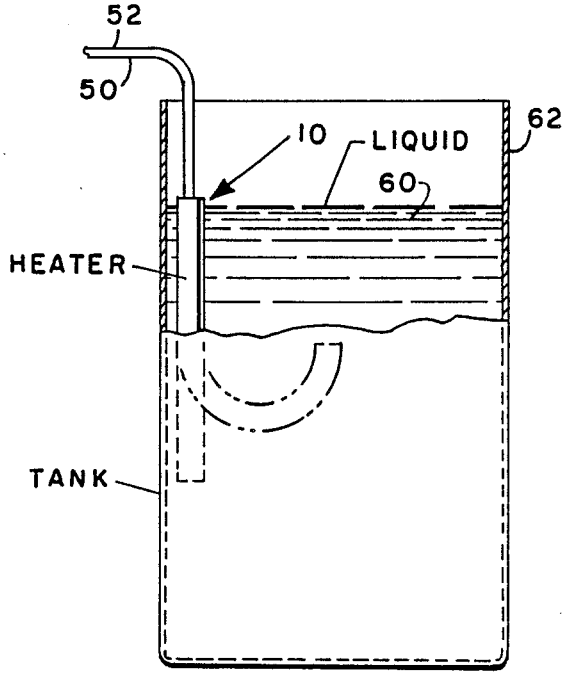
FIG. 3 is a schematic illustration showing the heater assembly of the present invention utilized in a typical environment to heat a tank of liquid which may be corrosive and showing in phantom lines an alternate shape of the heater assembly wherein the assembly is formed into a arcuate shape.

A pair of power leads 50, 52 are provided for energizing electrodes 30, 32 of heater assembly 10. When power is provided on leads 50, 52, metallic electrodes 30, 32 will be energized and a circuit will be completed between electrodes 30, 32 via the positive temperature coefficient elements 12. As current is passed through PTC elements 12, the PTC elements 12 generate heat by virtue of their internal resistance and the heat is transferred via the metallic electrodes 30, 32 through heat shrink tubing 38, metallic sheath 40 and polymeric sheath 44 to the environment in which heater assembly 10 is disposed. As is illustrated in FIG. 3, heater 10 can transfer heat to a liquid 60 in a tank 62 to effect heating of the liquid. Moreover, as is disclosed in phanton lines in FIG. 3, the heater assembly 10 can be bent or formed into various shapes to accommodate various desired heater configurations. While the PTC elements 12 are generally not flexible, the use of a sufficient number of spacers 18 between adjacent PTC elements 12 allow the assembly to be formed into various shapes.

The construction of the present heater 10 provides a heater which is particularly suited for use in hostile environments where the self-regulating effect of the PTC elements 12 occurs at a temperature which is below the ignition temperature of the hostile environment. In the present construction, the PTC elements were permitted a maximum temperature of 450° F. The combination of the silicon rubber compounded with iron oxide and the use of the heavy metallic electrodes 30, 32, thin walled heat shrink fluoropolymer tubing, metallic sheath 40 and heavy walled polymeric sleeve 44, minimize temperature build-up at the PTC elements 12 while providing good heat conductivity from the PTC elements 12 to the environment such as liquid 60.

From the foregoing it should be apparent that a new and improved self-regulating heater assembly and a method of manufacturing the heater assembly has been provided. The heater assembly includes a plurality of positive temperature coefficient elements 12 each of which includes a pair of substantially planar parallel surfaces 14 and 16, and a plurality of spacers 18 of an electrically insulative and thermally conductive material which are located between the PTC elements 12. The spacers 18 each has a pair of substantially planar parallel surfaces 22, 24 each of which is disposed coplanar to one of the parallel planar surfaces of the PTC elements. Metal electrodes 30, 32, for energizing the PTC elements are provided, each of which includes a planar surface 34 which is contiguous to and in contact with one of the planar surfaces of each spacer 18 and one of the planar surfaces of each of PTC elements 12. A heat shrink tubing 38 surrounds electrodes 30, 32 and spacers 18, and PTC elements 12, and is shrunk in situ to fix electrodes 30, 32 against the contiguous planar surface of spacers 18 and one of the planar surfaces of each of PTC elements 12. The heat shrink tubing 38 protects the PTC elements 12 and assists in the assembly of the heater by holding the PTC elements, spacers and electrodes in place while the metallic tube is located about the heat shrink tubing. The metallic sheath 40 is swaged or roll reduced to provide uniform and substantial electrical and thermal contact on the heat shrink tubing, the electrodes and finally the PTC elements 12 and provides a ground path to protect the heater assembly 10. A protective heat resistant and preferably a chemical and heat resistant sleeve surrounds the metallic sheath 40 to provide further protection to the assembly.

What we claim is:

1. A self-regulating heater assembly comprising a plurality of positive temperature coefficient (PTC) elements, each of which includes a pair of substantially planar parallel surfaces, a plurality of spacers formed from an electrically insulative and thermally conductive material, each of said spacers being disposed between adJacent ones of said plurality of PTC elements, a pair of electrodes for energizing said plurality of PTC elements, each of which has a planar surface, said planar surfaces of each of said electrodes being contiguous to and in contact with one of said planar surfaces of each of said PTC elements, a heat shrink tubing surrounding said pair of electrodes, said spacers and said PTC elements, said tubing being heat shrunk in situ to hold said plurality of spacers and said planar surfaces of each of said pair of metal electrodes against one of said planar surfaces of each of said PTC elements, and a tightly fitting metallic sheath surrounding said heat shrink tubing to compress said electrodes into contact with said PTC elements to establish substantially uniform electrical contact therebetween.

2. A self-regulating heater assembly as defined in claim 1 further wherein said plurality of spacers are flexible to enable said metallic sheath to be bent at said spacers.

3. A self-regulating heater assembly as defined in claim 2 further including a protective sleeve surrounding said metallic sheath.

4. A self-regulating heater assembly as defined in claim 1 wherein said heat shrink tubing is made from a polymer selected from the group consisting of fluorocarbon polymer, ethylenated fluorocarbon polymer, chlorinated fluorocarbon polymer, ethylenated/-chlorinated fluorocarbon polymer, polyvinyl fluorocarbon polymer, and perfluoroalkoxy polymer.

5. A self-regulating heater assembly as defined in claim 3 wherein said heat shrink tubing is made from a polymer selected from the group consisting of fluorocarbon polymer, ethylenated fluorocarbon polymer, chlorinated fluorocarbon polymer, ethylenated/-chlorinated fluorocarbon polymer, polyvinyl fluorocarbon polymer, and perfluoroalkoxy polymer.

6. A self-regulating heater assembly as defined in claim 5 wherein said protective sleeve is made from a polymer selected from the group consisting of fluorocarbon polymer, ethylenated fluorocarbon polymer, chlorinated fluorocarbon polymer, ethylenated/-chlorinated fluorocarbon polymer, polyvinyl fluorocarbon polymer, and perfluoroalkoxy polymer.

7. A self-regulating heater assembly as defined in claim 6 wherein said plurality of spacers comprises iron oxide compounded in silicon rubber.

8. A self-regulating heater assembly as defined in claim 1 wherein said tightly fitting metallic sheath is swaged about said heat shrink tube to compress said electrodes into contact with said PTC elements.

9. A self-regulating heater assembly as defined in claim 1 wherein said tightly fitting metallic sheath is roll reduced about said heat shrink tube to compress said electrodes into contact with said PTC elements.

10. A self-regulating heater assembly as defined in claim 1 wherein said metallic sheath provides a ground path to protect said heater assembly.

11. A method of manufacturing a self-regulating heater comprising the steps of; providing a plurality of positive temperature coefficient (PTC) elements, each of which has a pair of parallel planar surfaces;

locating a plurality of spacer elements made from an electrically insulative and thermally conductive material between adjacent PTC elements.

providing a pair of elongate electrodes, each of which has a planar surface, for energizing said PTC elements;

locating the planar surface of each of said electrodes in contact with one of the planar surfaces of each of said plurality of said PTC elements;

surrounding said pair of electrodes, said spacers, and said plurality of PTC elements with heat shrink tubing;

heating said heat shrink tubing to shrink said tubing and hold said planar surface of each of said electrodes in contact with the plurality of spacer elements and said plurality of PTC elements.

surrounding said heat shrink tubing with a metallic sheath; and reducing the diameter of said metallic sheath in situ to maintain substantially uniform electrical contact between said PTC elements and said metal electrodes.

12. A method of manufacturing a self-regulating heater assembly as defined in claim 11 wherein said step of surrounding said heat shrink tubing with a metallic sheath provides a ground path for said heater assembly and provides physical protection to said PTC elements.

13. A method of manufacturing a self-regulating heater assembly as defined in claim 11 further including the step of surrounding said metallic sheath with a protective sleeve adapted to protect said heater assembly from hostile environments.

14. A self-regulating heater assembly comprising a plurality of positive temperature coefficient (PTC) elements, a plurality of flexible spacer elements made from an electrically insulative and thermally conductive material, each of said plurality of spacer elements being disposed between adJacent PTC elements, a pair of electrodes for energizing said plurality of PTC elements, each of said electrodes being contiguous to and in contact with each of said PTC elements, a heat shrink tubing surrounding said pair of electrodes, said spacers and said PTC elements, said tubing being heat shrunk in situ to hold said pair of electrodes against said PTC elements and to hold said spacer elements between adjacent PTC elements, and a metallic sheath surrounding said heat shrink tubing and wherein the diameter of the metallic sheath is reduced in situ to compress said electrodes into contact with said PTC elements to establish substantially uniform electrical contact therebetween.

15. A self-regulating heater assembly as defined in claim 14 wherein said metallic sheath surrounding said heat shrink tubing thermally transfers heat away from said PTC elements, protects said PTC elements and provides a ground path for said heater assembly.

16. A self-regulating heater assembly as defined in claim 15 further including a protective sleeve surrounding said metallic sheath adapted to protect said metallic sheath from hostile environments.

17. A self-regulating heater assembly as defined in claim 16 wherein said heat shrink tubing is made from a polymer selected from the group consisting of fluorocarbon polymer, ethylenated fluorocarbon polymer, chlorinated fluorocarbon polymer, ethylenated/-chlorinated fluorocarbon polymer, polyvinyl fluorocarbon polymer, and perfluoroalkoxy polymer.

18. A self-regulating heater assembly as defined in claim 17 wherein said protective sleeve is made from a polymer selected from the group consisting of fluorocarbon polymer, ethylenated fluorocarbon polymer, chlorinated fluorocarbon polymer, perfluoroalkoxy polymer.

19. A self-regulating heater assembly as defined in claim 18 wherein said plurality of spacer elements comprises iron oxide compounded in silicon rubber and wherein said spacer elements are flexible to allow bending of said heater assembly at said spacer elements.

20. A method of manufacturing a self-regulating heater comprising the steps of;

providing a plurality of (PTC) elements.

locating a plurality of flexible spacer elements made from an electrically insulative and thermally conductive material between adjacent PTC elements.

providing a pair of elongate electrodes for energizing said PTC elements;

locating each of said electrodes in contact with the plurality of said PTC elements;

surrounding said pair of electrodes, said plurality of spacer elements, and said plurality of PTC elements with heat shrink tubing;

heating said heat shrink tubing to shrink said tubing and hold said electrodes in contact with said plurality of PTC elements and to hold said plurality of spacer elements between adJacent PTC elements;

surrounding said heat shrink tubing, said PTC elements, said electrodes and said plurality of spacer elements with a metallic sheath; and reducing the diameter of said metallic sheath to compress said electrodes into contact with each of said PTC elements.

21. A method of manufacturing a self-regulating heater assembly as defined in claim 19 wherein said step of surrounding said heat shrink tubing with a metallic sheath further provides a ground path for said heater assembly and provides physical protection to said PTC elements.

22. A method of manufacturing a self-regulating heater assembly as defined in claim 20 further including the step of surrounding said metallic sheath with a protective sleeve adapted to protect said heater assembly from hostile environments.

* * * * *